US008031147B2

(12) United States Patent
Jeon et al.

(10) Patent No.: US 8,031,147 B2
(45) Date of Patent: Oct. 4, 2011

(54) DISPLAY APPARATUS, AND METHOD AND APPARATUS FOR DRIVING THE SAME

(75) Inventors: Byung-Kil Jeon, Anyang-si (KR); Jun-Pyo Lee, Seongnam-si (KR); Woo-Chul Kim, Uijeongbu-si (KR)

(73) Assignee: Samsung Electronics Co., Ltd. (KR)

( * ) Notice: Subject to any disclaimer, the term of this patent is extended or adjusted under 35 U.S.C. 154(b) by 840 days.

(21) Appl. No.: 11/761,882

(22) Filed: Jun. 12, 2007

(65) Prior Publication Data

US 2007/0296669 A1 Dec. 27, 2007

(30) Foreign Application Priority Data

Jun. 27, 2006 (KR) ..... 10-2006-0057798

(51) Int. Cl.
*G09G 3/36* (2006.01)

(52) U.S. Cl. ..... 345/89; 345/98; 345/204

(58) Field of Classification Search ..... 345/87–98, 345/204
See application file for complete search history.

(56) References Cited

U.S. PATENT DOCUMENTS

2001/0038372 A1* 11/2001 Lee ..... 345/89
2003/0151599 A1* 8/2003 Bone ..... 345/204
2003/0193460 A1* 10/2003 Lee et al. ..... 345/87
2004/0041767 A1* 3/2004 Sugino ..... 345/89
2004/0196274 A1* 10/2004 Song et al. ..... 345/204
2004/0246220 A1* 12/2004 Cheon ..... 345/89
2005/0001802 A1* 1/2005 Lee ..... 345/89
2005/0093803 A1* 5/2005 Cheon et al. ..... 345/92
2006/0038765 A1* 2/2006 Lee et al. ..... 345/100

* cited by examiner

*Primary Examiner* — Amare Mengistu
*Assistant Examiner* — Premal Patel
(74) *Attorney, Agent, or Firm* — Cantor Colburn LLP

(57) ABSTRACT

A display apparatus includes a display panel, a gate driver, a gray scale compensator, and a date driver. The gate driver sequentially applies gate data to the gate lines. The gray scale compensator compares the primitive gray scale data of the n-th frame with the primitive gray scale data of the (n−1)-th frame to output a compensated gray scale data of a n-th frame, when a primitive gray scale data of a (n−1)-th frame is lower than a gray scale data of a first gray scale and a primitive gray scale data of the n-th frame is higher than a gray scale data of a second gray scale. The date driver converts the compensated gray scale data into a date voltage corresponding to the compensated gray scale data and applies the data voltage to the date line. Therefore, response time of the liquid crystal molecules may be reduced.

15 Claims, 7 Drawing Sheets

DISPLAY APPARATUS, AND METHOD AND APPARATUS FOR DRIVING THE SAME

This application claims priority to Korean Patent Application No. 2006-57798, filed on Jun. 27, 2006, and all the benefits accruing therefrom under 35 U.S.C. §119, the contents of which in its entirety are herein incorporated by reference.

BACKGROUND OF THE INVENTION

1. Field of the Invention

The present invention relates generally to a display apparatus, and method and apparatus for driving the same, and more particularly, to a display apparatus having enhanced response speed of liquid crystal, and a method and apparatus for driving the same.

2. Description of the Related Art

A liquid crystal display apparatus includes a color filter substrate having a common electrode, an array substrate having a pixel electrode and liquid crystal disposed between the color filter substrate and the array substrate. When an electric field is applied between the common electrode and the pixel electrode, the arrangement of liquid crystal molecules disposed between the common electrode and the pixel electrode is changed. When the arrangement of the liquid crystal molecules is changed, the transmittance of light therethrough is changed in accordance with the arrangement of liquid crystal molecules. As a result, an image is displayed.

A liquid crystal display apparatus is a flat panel type display apparatus that includes, for example, a thin film transistor as a switching device, and is used in application such as a monitor for a personal computer, a television receiver set, etc. Thus, such a liquid crystal display device requires the capability of displaying moving picture. However, the liquid crystal of a conventional liquid crystal display apparatus typically has slow response speed, so that the image display quality of the moving picture is somewhat deteriorated. In order to enhance the response speed of the liquid crystal, certain liquid crystal display devices may include an optically compensated (OCP) mode or a ferroelectric liquid crystal ("FLC").

On the other hand, in order to use the optically compensated ("OCP") mode and the ferroelectric liquid crystal, the design of a panel of such a liquid crystal display apparatus is significantly changed from those of traditional devices.

BRIEF SUMMARY OF THE INVENTION

Aspects of the present invention provide a display apparatus for displaying an enhanced moving picture.

The present invention also provides a driving apparatus for the above-mentioned display apparatus for reducing response time of liquid crystal molecules.

The present invention also provides a method for driving the above-mentioned display apparatus for reducing response time of liquid crystal molecules.

A display apparatus according to one exemplary embodiment of the present invention comprises a display panel displaying an image, a gate driver, a gray scale compensator, and a date driver. The display panel includes a plurality of pixels formed by a plurality of gate lines and data lines for displaying an image. The gate driver sequentially provides the gate lines with gate signals. The gray scale data compensator outputs a compensated gray scale data of a n-th frame whenever a primitive gray scale data of a (n−1)-th frame is lower than a first gray scale level and a primitive gray scale data of the n-th frame is higher than a second gray scale level in comparison with the primitive gray scale data of the n-th frame and the primitive gray scale data of the (n−1)-th frame. The compensated gray scale data is lower than the second gray scale level. The date driver converts the compensated gray scale data into a corresponding date voltage and provides the data line with the date voltage.

A driving apparatus of a display apparatus according to another exemplary embodiment of the present invention comprises a gate driver, a gray scale compensator, and a data driver. The gate driver sequentially provides the gate lines with gate signals. The gray scale compensator outputs a compensated gray scale data of a n-th frame when a primitive gray scale data of a (n−1)-th frame is lower than a first gray scale level and a primitive gray scale data of the n-th frame is higher than a second gray scale level in comparison with the primitive gray scale data of the n-th frame and the primitive gray scale data of the (n−1)-th frame. The compensated gray scale data is lower than the second gray scale level. The date driver converts the compensated gray scale data into a corresponding date voltage and provides the date line with the date voltage.

A method for driving a display apparatus according to another exemplary embodiment of the present invention comprises a step of sequentially providing a plurality of gate lines with gate signals, generating a compensated gray scale data of a n-th frame whenever primitive gray scale data of a (n−1)-th frame is lower than a first gray scale level and primitive gray scale data of the n-th frame is higher than a second gray scale level in comparison with the primitive gray scale data of the n-th frame and the primitive gray scale data of the (n−1)-th frame, wherein the compensated gray scale data is lower than the second gray scale level, and changing the compensated gray scale data into a corresponding date voltage and providing a data line with the date voltage.

According to an aspect of the present invention, whenever a primitive gray scale data of (n−1)-th frame is lower than the first gray scale level and a primitive gray scale data of n-th frame is higher than the second gray scale level, a compensated gray scale data lower than the second gray scale level is applied to the data line. Therefore, response time of the liquid crystal molecules may be reduced to enhance display quality.

BRIEF DESCRIPTION OF THE DRAWINGS

The above and other aspects, features and advantages of the present invention will become readily apparent by reference to the following detailed description when considered in conjunction with the accompanying drawings wherein.

DETAILED DESCRIPTION OF THE INVENTION

Figure 1:
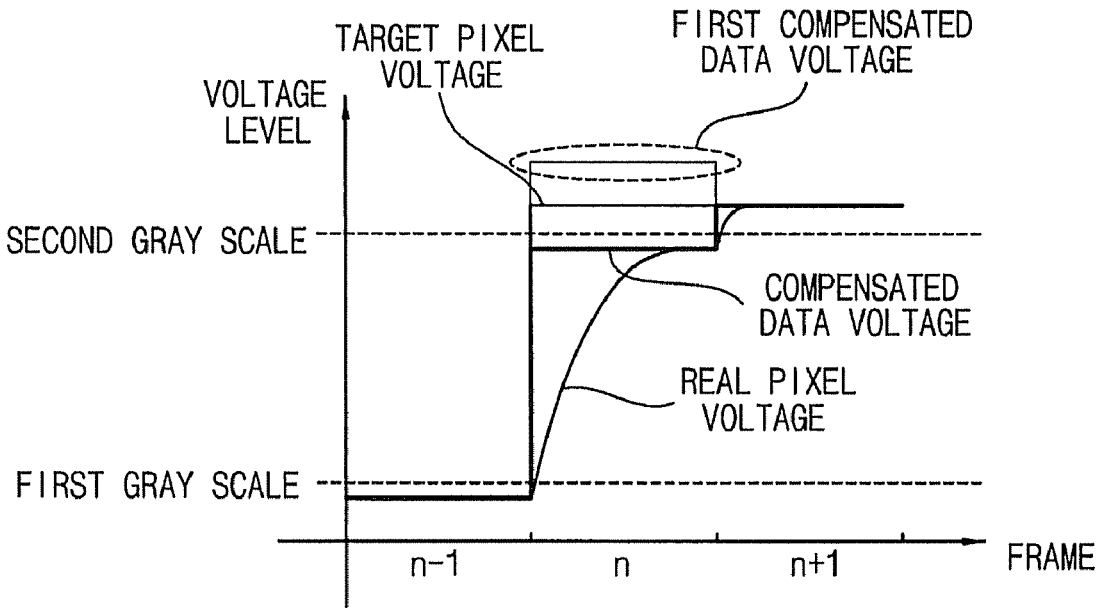
FIG. 1 is a graph illustrating a method of applying a data voltage according to an exemplary embodiment of the present invention.

The present invention is described more fully hereinafter with reference to the accompanying drawings, in which exemplary embodiments of the invention are shown. The present invention may, however, be embodied in many different forms and should not be construed as limited to the embodiments set forth herein. Rather, these exemplary embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the present invention are described herein with reference to cross-section illustrations that are schematic illustrations of idealized embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter the preferred embodiments of the present invention will be described in detail with reference to the accompanied drawings.

FIG. 1 is a graph showing a method of applying a data voltage according to an embodiment of the present invention.

A target pixel voltage of an n-th frame is compared with a target pixel voltage of a (n−1)-th frame so that a compensated data voltage is applied to a data line through a data driver. Thus, the time taken for a real pixel voltage charged in a pixel to reach a target pixel voltage may be reduced.

For example, when the target pixel voltage of the n-th frame is different from the target pixel voltage of the (n−1)-th frame, a compensated data voltage is applied to the data line through the data driver such that the target pixel voltage of the (n−1)-th frame is overshot (or undershot). Thus, the time for reaching a target pixel voltage is reduced, thus the response time of the associated liquid crystal is reduced. The compensated data voltage of the (n−1)-th frame is determined based on a liquid crystal capacitance, which is in turn determined by a pixel voltage of the (n−1)-th frame.

Still referring to FIG. 1, a target pixel voltage of the (n−1)-th frame is compared with the target pixel voltage of n-th frame so that a compensated pixel voltage of the n-th frame is applied to a data line through a data driver. Thus, the time taken for a real pixel voltage to reach a target pixel voltage is reduced during driving of the n-th frame.

When a gray scale level of the n-th frame is higher than a gray scale level of the (n−1)-th frame, a compensated data voltage for overshooting is applied to the data line through the data driver. For example, when a first pixel voltage corresponding to a first gray scale (which is lower than the first gray scale level) is changed into a second pixel voltage corresponding to a second gray scale (which is higher than the second gray scale level), the variation of the data voltage is greater than the response speed of liquid crystal molecules so that the liquid crystal molecules may not instantaneously respond to the variation of the data voltage instantly. The first gray scale is lower than the second gray scale. Thus, response time of the liquid crystal molecules may not be enhanced.

Therefore, when the first pixel voltage corresponding to the first gray scale is changed into the second pixel voltage corresponding to the second gray scale, the compensated data voltage corresponding to a gray scale, which is lower than the second gray scale level, is applied to the data line through the data driver so that the response time of the liquid crystal molecules is enhanced.

When the compensated data voltage for forming the gray scale level, which is lower than the second gray scale level, is below a certain level, an image may be not displayed. Thus, the compensated data voltage may be close to the target pixel voltage.

The second gray scale level is higher than the first gray scale level. Assuming a black gray scale corresponds to a 0% gray level and a white gray scale corresponds to a 100% gray level, the first gray scale level and the second gray scale level respectively correspond to a 15% gray level and a 95% gray level, and an exemplary range of the compensated gray scale corresponds to about 90% to about 95% gray levels.

In one specific example, the first gray scale level and the second gray scale level respectively correspond to a 30th gray scale level and a 250th gray scale level, and the compensated data voltage corresponds to a range from a 238th gray scale level to a 242nd gray scale level. In an even more specific example, the compensated data voltage corresponds to a 240th gray scale level. Total gray scale levels correspond to a range from a 0th gray scale level (black) to a 255th gray scale level(s).

The first gray scale level and the second gray scale level may be variably changed. The compensated data voltage may have a constant value that is independent from the gray scale levels, and may have different values from one other such that the compensated data voltage corresponds to each of the gray scale levels.

When the gray scale level of the (n−1)-th frame is different from the gray scale level of the n-th frame, a compensated data voltage for overshooting (or undershooting) is applied to the data line through the data driver. When a gray scale level is changed from a first level that is lower than the first gray scale level to a second level that is higher than the second gray scale level, the compensated data voltage corresponding to the gray scale, is applied to the data line through the data driver. Thus, the response time of liquid crystal molecules may be reduced.

Figure 2:
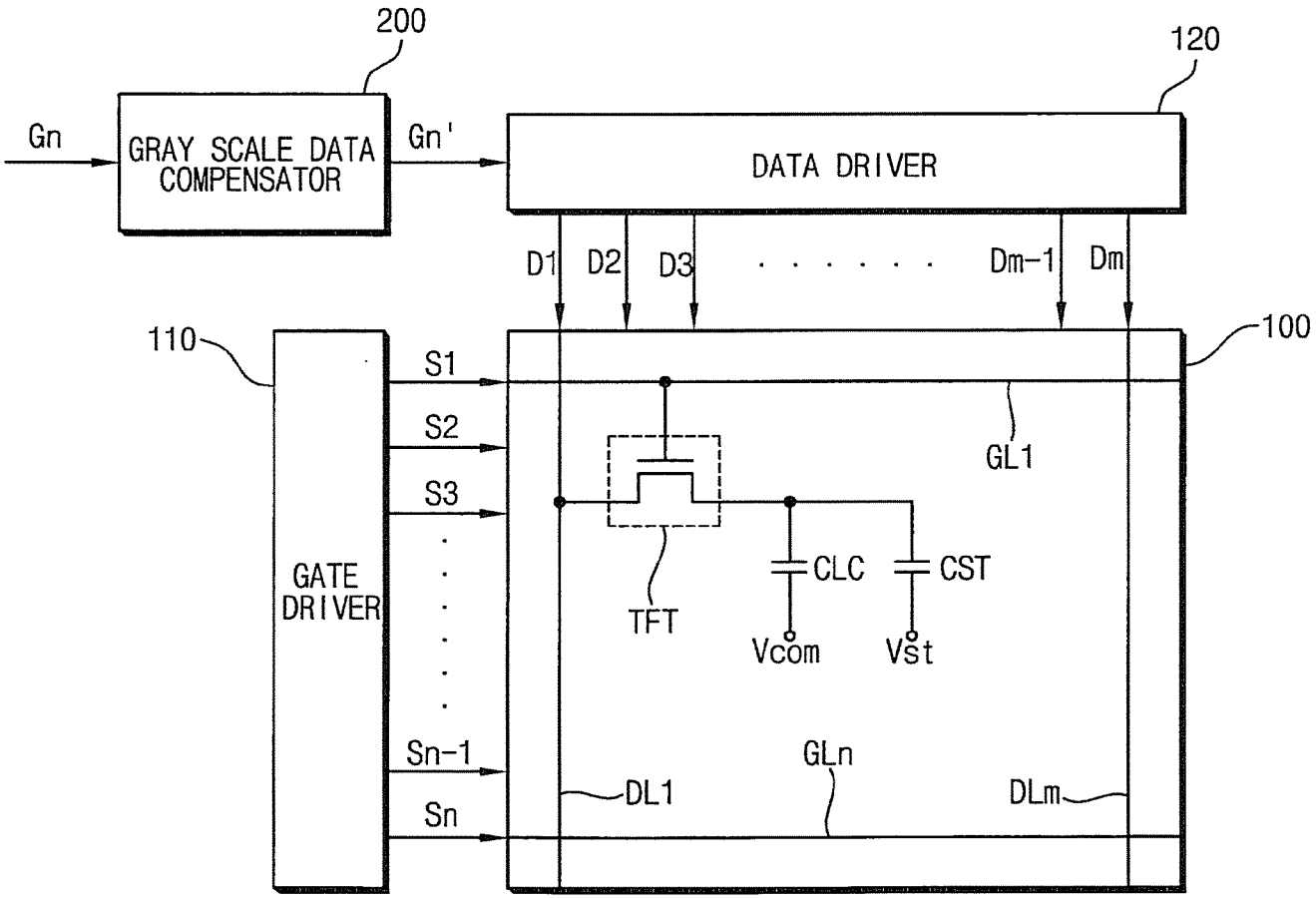
FIG. 2 is a block diagram illustrating a display apparatus according to another exemplary embodiment of the present invention.

FIG. 2 is a block diagram showing a display apparatus according to another exemplary embodiment of the present invention.

Referring to FIG. 2, a display apparatus according to an exemplary embodiment of the present invention includes a display panel 100 configured to display an image, a gate driver 110, a gray scale compensator 200, and a data driver 120.

The gate driver 110, the data driver 120, and the gray scale data compensator 200 are driving devices of a display device, which convert an image signal applied by an external source (not shown) into a signal that is applied to the display panel 100.

The display panel 100 includes a plurality of gate lines GL1, . . . , GLn and a plurality of data lines DL1, . . . , DLm. A plurality of gate signals S1, . . . , Sn generated by the gate driver 110 are applied to the gate lines GL1, . . . , GLn, and compensated data voltages corresponding to data signals are applied to the data lines DL1, . . . , DLm by the data driver 120. The data lines DL1, . . . , DLm are disposed in a direction different from the gate lines GL1, . . . , GLn (e.g., the data lines are orthogonal to the gate lines). A plurality of pixels is formed at the intersections of the gate lines GL1, . . . , GLn and the data lines DL1, . . . , DLm. Each pixel includes a thin film transistor (TFT), a liquid crystal capacitor (CLC), and a storage capacitor (CST). The liquid crystal capacitor (CLC) and the storage capacitor (CST) are electrically connected to the thin film transistor (TFT). For example, a gate electrode and a data electrode of the thin film transistor (TFT) are respectively connected to one of the gate lines GL1, . . . , GLn and one of the data lines DL1, . . . , DLm, and a drain electrode of the thin film transistor (TFT) is electrically connected to the liquid crystal capacitor (CLC) and the storage capacitor (CST).

The gate driver 110 drives the gate lines GL1, . . . , GLn formed on the display panel 100. That is, the gate driver 110 successively applies the gate signals S1, . . . , Sn to the gate lines GL1, . . . , GLn, to turn on the thin film transistor.

The data driver 120 receives the compensated gray scale data Gn' from the gray scale data compensator 200 and applies the data signals D1, . . . , Dm, which comprise data voltages (gray scale voltages) corresponding to the compensated gray scale data Gn', to the data lines DL1, . . . , DLm.

The gray scale compensator 200 receives primitive gray scale data Gn of the n-th frame supplied by a gray scale data source (not shown). The gray scale compensator 200 compares the received primitive gray scale data Gn of the n-th frame with a stored primitive gray scale data Gn-1 of the (n−1)-th frame to output a compensated gray scale data Gn' of the n-th frame.

The primitive gray scale data Gn-1 of the (n−1)-th frame is compared with the primitive gray scale data Gn of the n-th frame. When the (value of the) primitive gray scale data Gn-1 of the (n−1)-th frame is lower than that of the first gray scale level, and the primitive gray scale data Gn of the n-th frame is higher than the second gray scale level, the gray scale compensator 200 outputs a compensated gray scale data Gn' that is lower than the second gray scale level.

When the primitive gray scale data Gn-1 of the (n−1)-th frame is substantially the same as the primitive gray scale data Gn of the n-th frame, the gray scale data compensator 200 outputs a compensated gray scale data Gn' that is substantially the same as the received primitive gray scale data Gn of the n-th frame. When the primitive gray scale data Gn-1 of the (n−1)-th frame is different from the primitive gray scale data Gn of the n-th frame, the gray scale compensator 200 outputs the compensated gray scale data Gn' for overshooting (or undershooting).

Further, when the primitive gray scale data Gn-1 of the (n−1)-th frame is lower than the first gray scale level and the primitive gray scale data Gn of the n-th frame is higher than the second gray scale level, the gray scale data compensator 200 does not output the compensated gray scale data Gn' for overshooting (or undershooting), but rather outputs the compensated gray scale data Gn' that is lower than the second gray scale level.

In FIG. 2, the gray scale data compensator 200 is formed as a stand-alone unit. However, the gray scale data compensator 200 may be integrally formed with other devices such as, for example, a graphic card, a liquid crystal display module, a timing controller, a data driver, etc.

As described above, according to the present invention, the data voltage is compensated, and the compensated data voltage is applied to the pixel, so that the time taken for the pixel voltage to reach the target pixel voltage may be decreased. Thus, even though a structure of a liquid crystal display panel or a property of liquid crystal is not changed, the response time of liquid crystal is reduced to display a moving picture.

Figure 3:
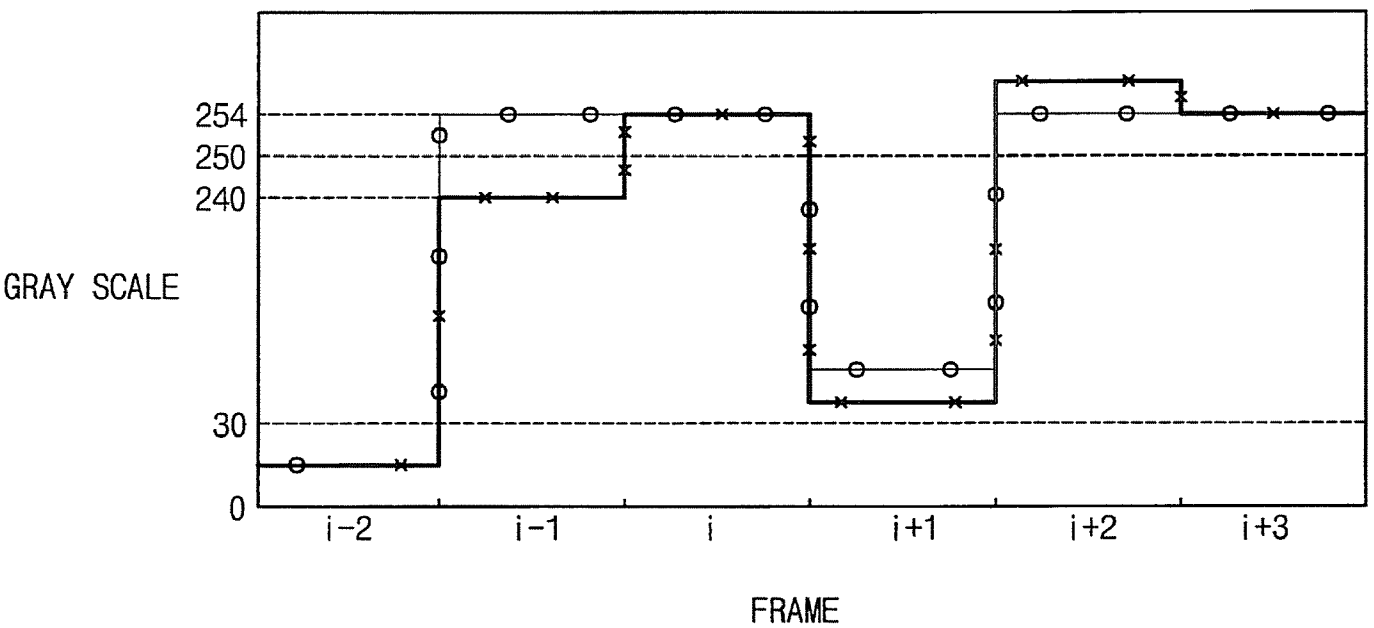
FIG. 3 is a timing diagram showing a compensated gray scale data in comparison with a primitive gray scale data according to another exemplary embodiment of the present invention.

FIG. 3 is a timing diagram illustrating compensated gray scale data in comparison with primitive gray scale data according to another exemplary embodiment of the present invention.

Referring to FIG. 3, primitive gray scale data Gn of an (i−2)-th frame, an (i−1)-th frame, an i-th frame, and an (i+1)-th frame respectively correspond to a 25th gray scale level, a 254th gray scale level, another 254th gray scale level and a 55th gray scale level, wherein 'i' is a natural number.

When the primitive gray scale data Gn are applied to a gray scale data compensator 200, the compensated gray scale data Gn' is substantially the same as the primitive gray scale data Gn during the (i−2)-th frame.

During the (i−1)-th frame, the primitive gray scale data of the (i−2)-th frame is a 25th gray scale level, and thus has a lower gray scale level that is lower than the first gray scale level, which is a 30th gray scale level in the example depicted. The primitive gray scale data of the (i−1)-th frame is a 254th gray scale level, and thus has a higher gray scale level than the second gray scale level, which is a 250th gray scale level in the example depicted. Therefore, the gray scale compensator 200 outputs a compensated gray scale data Gn' for forming a gray scale that is lower than the second gray scale level. In this instance, the gray scale compensator 200 outputs the gray scale data of a 240th gray scale level for the (i−1)-th frame.

The primitive gray scale data of the (i−1)-th frame is substantially the same as the primitive gray scale data Gn of the i-th frame during the i-th frame, so that the gray scale compensator 200 outputs a compensated gray scale data Gn' substantially the same as the primitive gray scale data Gn for the i-th frame.

The primitive gray scale data of the (i+1)-th frame is lower than the primitive gray scale data of the i-th frame, thus the gray scale compensator 200 outputs a compensated gray scale data Gn' for undershooting.

During the (i+2)-th frame, the primitive gray scale data of the (i+2)-th frame is higher than the second gray scale level at the 250th gray scale level. However, because the primitive gray scale data of the (i+1)-th frame, which is a 55th gray scale level, is not lower than the first gray scale level (30th gray scale level), the gray scale compensator 200 outputs a compensated gray scale data Gn' in the (i+2)-th frame for overshooting.

Finally, the primitive gray scale data of the (i+3)-th frame is substantially the same as the primitive gray scale data of the (i+2)-th frame, thus the gray scale compensator 200 outputs a compensated gray scale data Gn' substantially the same as the primitive gray scale data Gn.

According to an exemplary embodiment of the present invention, when the primitive gray scale data of the (n−1)-th frame is lower than the first gray scale level and the primitive gray scale data of the n-th frame is higher than the second gray scale level, the gray scale compensator does not output the compensated gray scale data for overshooting but instead outputs a compensated gray scale data that is lower than the second gray scale level. Thus, the response time of liquid crystal molecules may be enhanced.

Figure 4:
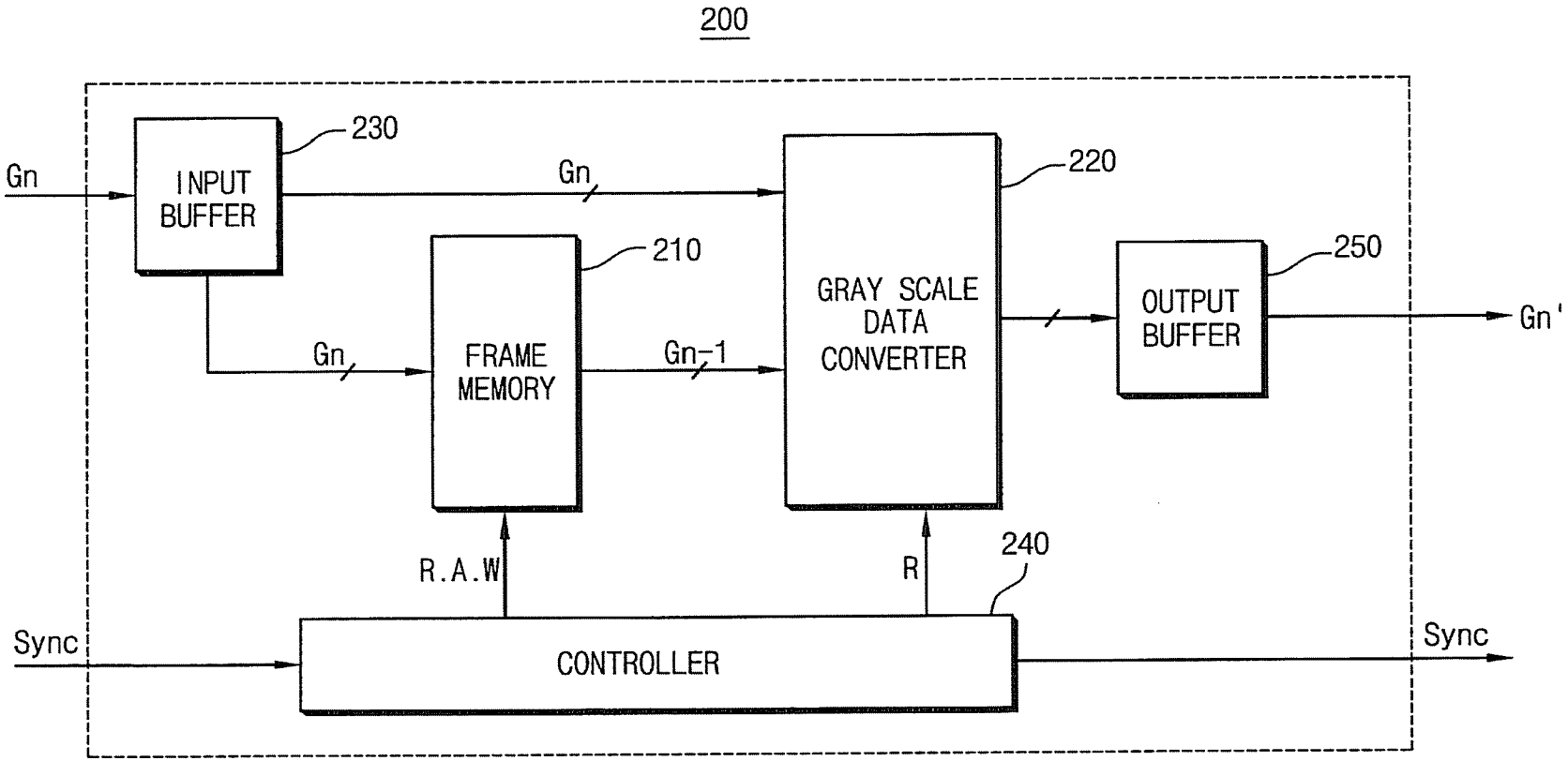
FIG. 4 is a block diagram illustrating the gray scale data compensator of FIG. 2 in further detail.

FIG. 4 is a block diagram illustrating the gray scale data compensator 200 of FIG. 2 in further detail.

Referring to FIG. 4, the gray scale compensator 200 according to the exemplary embodiment of the present invention includes an input buffer 230, a frame memory 210, a controller 240, a gray scale converter 220, and an output buffer 250. The gray scale compensator 200 receives the primitive gray scale data of the n-th frame, and compares the primitive gray scale data Gn of the n-th frame with the primitive gray scale data Gn-1 of the (n−1)-th frame to output the compensated gray scale data Gn' of the n-th frame.

The input buffer 230 receives the primitive gray scale data of the n-th frame transferred from the gray scale data source and changes the frequency of a data stream corresponding to the gray scale data compensator 200 so that the gray scale data compensator 200 processes the changed data stream having the changed frequency. The input buffer 230 applies the changed data stream to the frame memory 210 and the gray scale data converter 220.

The frame memory 210 stores the primitive gray scale data Gn of the n-th frame and outputs the stored primitive gray scale data Gn-1 of (n−1)-th frame. The frame memory 210 stores the primitive gray scale data Gn of the n-th frame provided by the input buffer 230 in response to an address clock signal A and a write clock signal W provided by the controller 240. The frame memory 210 outputs the stored primitive gray scale data Gn-1 of the (n−1)-th frame in response to the address clock signal A and the write clock signal W.

The gray scale data converter 220 receives the primitive gray scale data Gn of the n-th frame outputted by the input buffer 230 and the primitive gray scale data of the (n−1)-th frame outputted by the frame memory 210 in response to a read clock signal R. The gray scale converter 220 compares the primitive gray scale data Gn-1 of the (n−1)-th frame with the primitive gray scale data Gn of the n-th frame to generate the compensated gray scale data Gn' of the n-th frame, and applies the compensated gray scale data Gn' of the n-th frame to the output buffer 250.

When the primitive gray scale data Gn-1 of the (n−1)-th frame is different from the primitive gray scale data Gn of the n-th frame during driving of the n-th frame, the gray scale data converter 220 generates the compensated gray scale data Gn' for overshooting. However, when the primitive gray scale data Gn-1 of the (n−1)-th frame is lower than the first gray scale level and the primitive gray scale data Gn of the n-th frame is higher than the second gray scale level, the gray scale data converter 220 does not generate compensated gray scale data for overshooting, but instead generates compensated gray scale data that is lower than the second gray scale level.

When the primitive gray scale data Gn of the n-th frame is higher than the primitive gray scale data Gn-1 of the (n−1)-th frame, the gray scale data converter 220 generates and outputs the compensated gray scale data for undershooting.

The controller 240 controls storage of the primitive gray scale data in the frame memory 210 and outputting of the primitive gray scale data from the frame memory 210 on the basis of a sync signal provided from an external source (not shown), and generates a controlling signal, such as the read clock signal R, the write clock signal W, and the address clock signal A, to control operations of the gray scale data converter 220.

The output buffer 250 adjusts the frequency of a data stream so that a transferring system processes the changed data stream having the adjusted frequency to output the changed data stream.

In FIG. 4, the input buffer 230 and the output buffer 250 are specifically included within the gray scale data compensator 200. Alternatively, the input buffer 230 and the output buffer 250 may be omitted.

Figure 5:
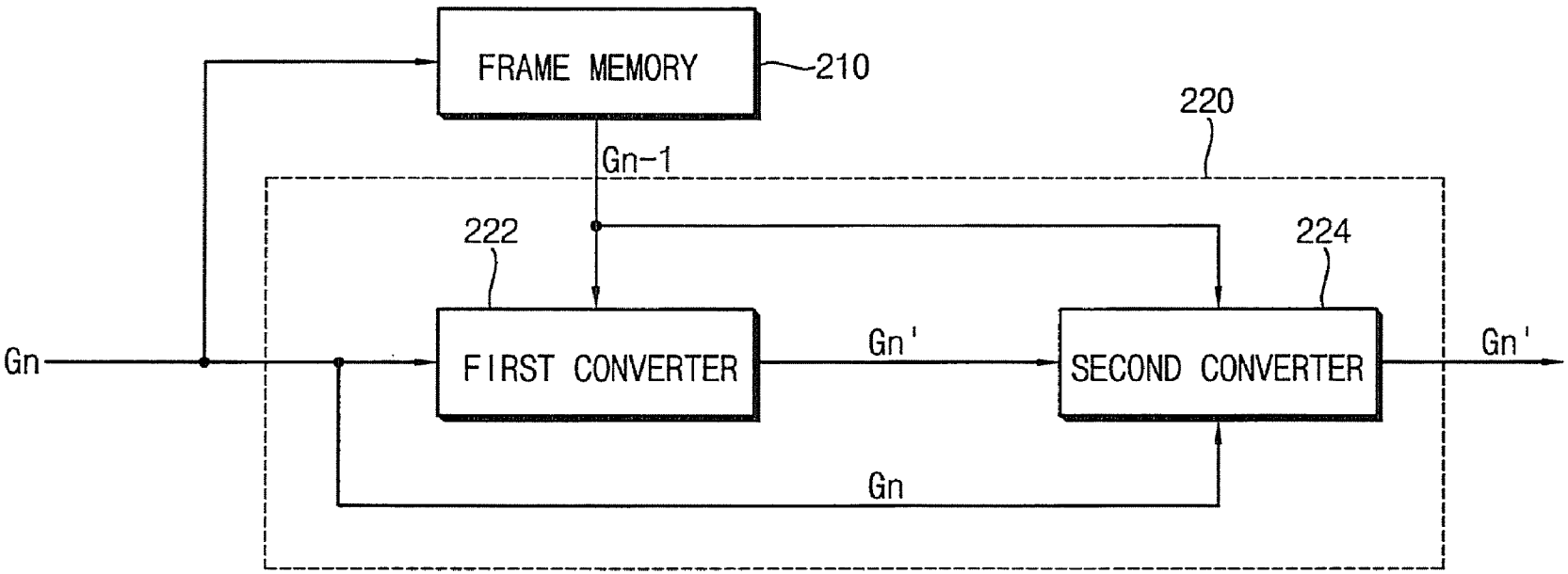
FIG. 5 is a block diagram illustrating the gray scale data converter of FIG. 4 in further detail.

FIG. 5 is a block diagram illustrating the gray scale data converter 220 of FIG. 4 in further detail.

Referring to FIGS. 4 and 5, the gray scale data converter 220 includes a first converter 222 and a second converter 224. The first converter 222 generates a gray scale data for overshooting (or undershooting). The second converter 224 generates a compensated gray scale data Gn'.

The first converter 222 receives the primitive gray scale data Gn of the n-th frame from the output buffer 250, and also receives the primitive gray scale data Gn-1 of the (n−1)-th frame from the frame memory 210. The first converter 222 compares the primitive gray scale data Gn-1 of the (n−1)-th with the primitive gray scale data Gn of the n-th frame to generate a gray scale data for overshooting (or undershooting).

For example, when the primitive gray scale data Gn-1 of the (n−1)-th frame is different from the primitive gray scale data Gn of the n-th frame, the first converter 222 generates a gray scale data for overshooting (or undershooting). The gray scale data generated by the first converter 222 is transferred into the second converter 224.

The second converter 224 receives the primitive gray scale data Gn of the n-th frame from the output buffer 250, and also receives the primitive gray scale data Gn-1 of the (n−1)-th frame from the frame memory 210. In addition, the second converter 224 also receives the gray scale data for overshooting (or undershooting) generated by the first converter 222.

The primitive gray scale data Gn-1 of the (n−1)-th frame is compared with the primitive gray scale data Gn of the n-th frame. When the primitive gray scale data Gn-1 of the (n−1)-th frame is lower than the first gray scale level and the primitive gray scale data Gn of the n-th frame is higher than the second gray scale level, the second converter 224 changes the gray scale data for overshooting (or undershooting) into a compensated gray scale data Gn' that is lower than the second gray scale level.

For example, when the primitive gray scale data Gn-1 of the (n−1)-th frame is lower than the first gray scale level, and the primitive gray scale data Gn of the n-th frame is higher than the second gray scale level, the second converter 224 converts the gray scale data generated by the first converter 222 into the compensated gray scale data that is lower than the second gray scale level to output the compensated gray scale data. When the primitive gray scale data Gn-1 and Gn of the (n−1)-th and n-th frames does not satisfy the condition that the primitive gray scale data Gn-1 of the (n−1)-th frame is lower than the first gray scale level and the primitive gray scale data Gn of the n-th frame is higher than the second gray scale level, the second converter 224 outputs a compensated gray scale data, which is substantially the same as the gray scale data generated by the first converter 222.

The gray scale data converter 220 compares the primitive gray scale data Gn-1 of the (n−1)-th frame with the primitive gray scale data Gn of the n-th frame to generate a gray scale data for overshooting (or undershooting). When the primitive gray scale data Gn-1 of the (n−1)-th frame is lower than the first gray scale level and the primitive gray scale data Gn of the n-th frame is higher than the second gray scale level, the gray scale data converter 220 changes the gray scale data into the compensated gray scale data Gn' that is lower than the second gray scale level to output the compensated gray scale data Gn' into the data driver 120 (FIG. 2).

The gray scale data converter 220 may further include a comparator (not shown) that compares the primitive gray scale data of the (n−1)-th frame with the primitive gray scale data of the n-th frame.

Figure 6:
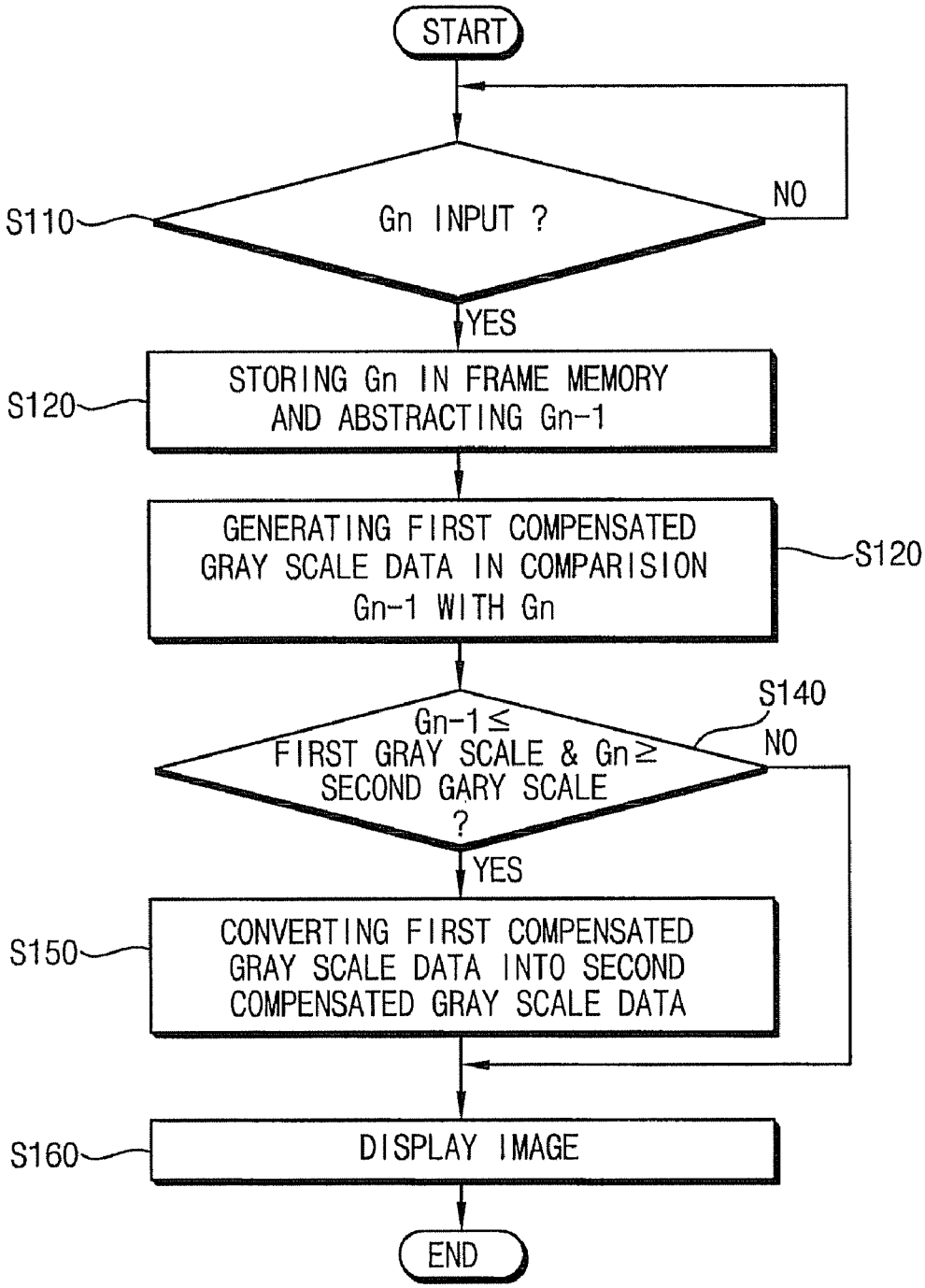
FIG. 6 is a flow chart illustrating an operation of the gray scale data converter shown in FIG. 4.

FIG. 6 is a flow chart showing an operation of the gray scale data converter shown in FIG. 4 and particularly describes operations of the gray scale data compensator according to an exemplary embodiment of the present invention.

Referring to FIGS. 4 through 6, the input buffer 230 is checked to see whether the primitive gray scale data Gn of the n-th frame has been input thereto from a host, such as an external device, as reflected in decision block S110 of FIG. 6. In block S120 of FIG. 6, the frame memory 210 stores the primitive gray scale data of the n-th frame once it is determined in block S110 step that the primitive gray scale data Gn is inputted. In addition, the primitive gray scale data Gn-1 of the (n−1)-th frame, which is stored in the frame memory 210, is read out from the frame memory 210.

The primitive gray scale data Gn-1 of the (n−1)-th frame read out from the frame memory 210 is then compared with the primitive gray scale data Gn of the n-th frame so that a first compensated gray scale data Gn' for overshooting (or undershooting) is generated, as shown in block S130.

Proceeding to decision block S140, the primitive gray scale data Gn-1 of the (n−1)-th frame and the primitive gray scale data Gn of the n-th frame are checked to determine whether the primitive gray scale data Gn-1 of the (n−1)-th frame is lower than the first gray scale level and the primitive gray scale data Gn of the n-th frame is higher than the second gray scale level, or not (step S140). A first level that is lower than the first gray scale level may correspond to a full-black gray scale or a gray scale close to the full-black gray scale. A second level that is higher than the second gray scale level may correspond to a full-white gray scale level or a gray scale close to the full-white gray scale.

Whenever the primitive gray scale data Gn-1 of the (n−1)-th frame and the primitive gray scale data Gn of the n-th frame do not satisfy a condition that the primitive gray scale data Gn-1 of the (n−1)-th frame is lower than the first gray scale level and the primitive gray scale data Gn of the n-th frame is higher than the second gray scale level, an image is displayed through using the gray scale data for overshooting as a final compensated gray scale Gn', as reflected in block S160. However, when the primitive gray scale data Gn-1 of the (n−1)-th frame and the primitive gray scale data Gn of the n-th frame satisfy this condition, the first compensated gray scale data is converted into a second compensated gray scale, as shown in block S150. Then, in block S160, the image is displayed through using the second compensated gray scale data as the final compensated gray scale data.

In an exemplary embodiment, a driving frequency of the display apparatus may be about 120 Hz.

Figure 7:
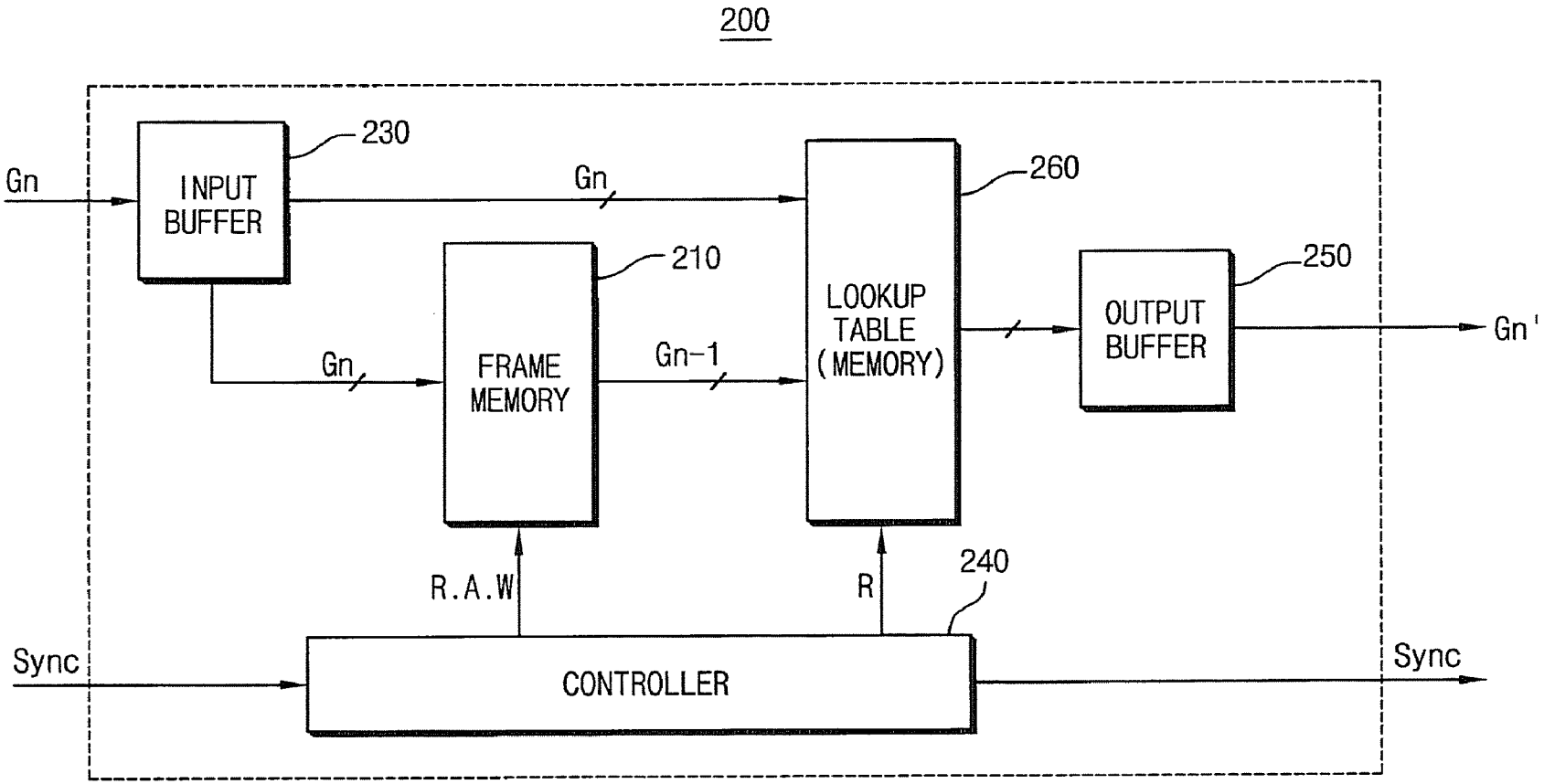
FIG. 7 is a block diagram showing another exemplary embodiment of the gray scale data compensator shown in FIG. 2.

FIG. 7 is a block diagram illustrating another exemplary embodiment of the gray scale data compensator 200 shown in FIG. 2.

Referring to FIG. 7, a gray scale data compensator 200 according to another exemplary embodiment of the present invention includes an input buffer 230, a frame memory 210, a controller 240, a lookup table 260, and an output buffer 250. The gray scale data compensator 200 receives the primitive gray scale data Gn of the n-th frame and compares the primitive gray scale data Gn of the n-th frame with the primitive gray scale data Gn-1 of the (n−1)-th frame and outputs a compensated gray scale data Gn' of the n-th frame.

The gray scale data compensator 200 of FIG. 7 is the same as in FIG. 4, except that a lookup table 260 is used in lieu of the gray scale data converter 220 of FIG. 4. Accordingly, the same reference numerals will be used to refer to the same or like parts as those described in FIG. 4, and any further explanation concerning the above elements will be omitted.

The frame memory 210 stores the primitive gray scale data Gn of the n-th frame, and outputs the stored primitive gray scale data Gn-1 of the (n−1)-th frame.

The lookup table 260 may be a memory, and has a variable that includes the primitive gray scale data Gn-1 and Gn of the (n−1)-th and n-th frames and a target value that includes the compensated gray scale data Gn'. The lookup table 260 outputs the compensated gray scale data Gn' as the target value based on the primitive gray scale data Gn-1 and Gn of the (n−1)-th and n-th frames.

For example, when the primitive gray scale data Gn of the n-th frame is changed into a gray scale level that is higher than the primitive gray scale data Gn-1 of the (n−1)-th frame, the target value of the lookup table 260 is a gray scale data for overshooting. When the primitive gray scale data Gn of the n-th frame is changed into a gray scale level that is lower than the primitive gray scale data Gn-1 of the (n−1)-th frame, the target value of the lookup table 260 is a gray scale data for undershooting.

When the primitive gray scale data Gn-1 of the (n−1)-th frame is lower than the first gray scale level and the primitive gray scale data Gn of the n-th frame is higher than the second gray scale level, the target value of the lookup table 260 is the compensated gray scale data that is lower than the first gray scale level.

The controller 240 controls storage of the primitive gray scale data Gn in the frame memory 210 and outputting of the primitive gray scale data Gn from the frame memory 210. In addition, the controller 240 controls operations of the lookup table 260.

In FIG. 7, the input buffer 230 and the output buffer 250 are specifically included within the gray scale data compensator 200. Alternatively, the input buffer 230 and the output buffer 250 may be omitted.

The gray scale data compensator 200 according to the embodiment of FIG. 7 does not require a checking step to determine whether or not the n-th and (n−1)-th frames meet the above-mentioned condition. The gray scale data compensator 200 only outputs the compensated gray scale data according to the lookup table 260. Thus, operations of the gray scale data compensator 200 according to the exemplary embodiment of the present invention may be simplified.

When the primitive gray scale data Gn-1 of the (n−1)-th frame is lower than the first gray scale level and the primitive gray scale data Gn of the n-th frame is higher than the second gray scale level, the gray scale data compensator 200 uses the lookup table 260 so that the target value is lower than the second gray scale level.

A primitive gray scale data of a (n−1)-th frame is compared with a primitive gray scale data of an n-th frame so that a compensated gray scale data is outputted. Whenever the primitive gray scale data of (n−1)-th frame is lower than the first gray scale level and the primitive gray scale data of n-th frame is higher than the second gray scale level, the compensated gray scale data, which is lower than the second gray scale level, is outputted. Therefore, the response time of the liquid crystal molecules may be reduced to enhance display quality.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus, comprising:

a display panel configured to display an image through a plurality of pixels defined by a plurality of gate lines and a plurality of data lines;

a gate driver configured to sequentially apply gate signals to the gate lines;

a gray scale data compensator configured to determine if a primitive gray scale data of an (n−1)-th frame is lower than a first gray scale level, the gray scale data compensator further configured to determine if a primitive gray scale data of an n-th frame is higher than a second gray scale level that is higher than the first gray scale level, and the gray scale data compensator further configured to output a first compensated gray scale data of the n-th frame if the primitive gray scale data of the (n−1)-th frame is lower than the first gray scale level and the primitive gray scale data of the n-th frame is higher than the second gray scale level, the compensated gray scale data of the n-th frame being lower than the second gray scale level; and a data driver configured to convert the first compensated gray scale data of the n-th frame into a data voltage corresponding to the compensated gray scale data of the n-th frame to apply the data voltage to the data lines.

2. The display apparatus of claim 1, wherein the first and second gray scale levels respectively correspond to about a 15% gray level and about a 95% gray level, and a range of the first compensated gray scale data corresponds to about 90% to about 95% gray levels, wherein a black gray scale corresponds to about a 0% gray level and a white gray scale corresponds to about a 100% gray level.

3. The display apparatus of claim 2, wherein the first gray scale level, the second gray scale level, and the first compensated gray scale level respectively correspond to a 30th gray scale level, a 250th gray scale level, and a 240th gray scale level, wherein total gray scale levels correspond to a range from 0th gray scale level to 255th gray scale level.

4. The display apparatus of claim 1, wherein the gray scale compensator comprises:

a frame memory configured to store the primitive gray scale data of the n-th frame and output a stored primitive gray scale data of the (n−1)-th frame; and a gray scale data converter configured to compare the primitive gray scale data of the n-th frame with the primitive gray scale data of the (n−1)-th frame to generate a second compensated gray scale data, the first compensated gray scale data being generated based on the second compensated gray scale data.

5. The display apparatus of claim 4, wherein the gray scale data converter comprises:

a first converter configured to compare the primitive gray scale data of the (n−1)-th frame with the primitive gray scale data of the n-th frame to generate a gray scale data for one of overshooting and undershooting; and a second converter configured to convert the gray scale data generated by the first converter into the second compensated gray scale data.

6. The display apparatus of claim 4, wherein the gray scale data converter comprises a lookup table having a variable corresponding to values of the primitive gray scale data of the (n−1)-th and n-th frames, and a target value that is a value of the second compensated gray scale data.

7. The display apparatus of claim 4, wherein the gray scale data compensator further comprises:

an input buffer configured to buffer an inputted gray scale data and apply the inputted gray scale data to the frame memory and the gray scale data converter; and a controller configured to control storage of the inputted gray scale data in the frame memory and outputting of the inputted gray scale data from the frame memory, and to control operations of the gray scale data converter.

8. A driving apparatus for driving a display apparatus including a plurality of pixels defined by a plurality of gate lines and a plurality of data lines, the driving apparatus comprising:

a gate driver configured to sequentially apply the gate signals to the gate lines;

a gray scale data compensator configured to determine if a primitive gray scale data of an (n−1)-th frame is lower than a first gray scale level, the first gray scale level being a 15% gray level, the gray scale data compensator further configured to determine if the primitive gray scale data of the n-th frame is higher than a second gray scale level that is higher than the first gray scale level, the second gray scale level being a 95% gray level, and the gray scale data compensator further configured to output a compensated gray scale data of the n-th frame if the primitive gray scale data of the (n−1)-th frame is lower than the first gray scale level and the primitive gray scale data of the n-th frame is higher than the second gray scale level, the compensated gray scale data of the n-th frame being lower than the second gray scale level; and a data driver configured to convert the compensated gray scale data of the n-th frame into a data voltage corresponding to the compensated gray scale data of the n-th frame to apply the data voltage to the data lines.

9. The driving apparatus of claim 8, wherein a range of the compensated gray scale corresponds to about 90% to about 95% gray levels, wherein a black gray scale corresponds to about a 0% gray level and a white gray scale corresponds to about a 100% gray level.

10. A method for driving a display apparatus, the method comprising:

sequentially applying a plurality of gate signals to a plurality of gate lines;

determining if a primitive gray scale data of an (n−1)-th frame is lower than a first gray scale level utilizing a gray scale data compensator;

determining if the primitive gray scale data of the n-th frame is higher than a second gray scale level that is higher than the first gray scale level utilizing the gray scale data compensator; generating a first compensated gray scale data of the n-th frame if the primitive gray scale data of the (n−1)-th frame is lower than the first gray scale level and the primitive gray scale data of the n-th frame is higher than the second gray scale level, the compensated gray scale data of the n-th frame being lower than the second gray scale level utilizing the gray scale data compensator; and converting the compensated gray scale data of the n-th frame into a data voltage to the compensated gray scale data of the n-th frame to apply the data voltage to the data lines.

11. The method of claim 10, wherein the first gray scale level and the second gray scale level respectively correspond to a 15% gray level and a 95% gray level, and a range of the first compensated gray scale data corresponds to about 90% to about 95% gray levels, wherein a black gray scale corresponds to about a 0% gray level and a white gray scale corresponds to about a 100% gray level.

12. The method of claim 11, wherein the first gray scale level, the second gray scale level, and the first compensated gray scale level respectively correspond to a 30th gray scale level, a 250th gray scale level, and a 240th gray scale level, wherein total gray scale levels correspond to a range from a 0th gray scale level to a 255 gray scale level.

13. The method of claim 10, further comprising:

storing the primitive gray scale data of the n-th frame and outputting a stored primitive gray scale data of the (n−1)-th frame;

comparing the primitive gray scale data of the (n−1)-th frame with the primitive gray scale data of n-th frame to generate a gray scale data for one of overshooting and undershooting; and converting the gray kale data for overshooting into a second compensated gray scale data.

14. The method of claim 10, further comprising:

storing the primitive gray scale data of the n-th frame and outputting a stored primitive gray scale data of the (n−1)-th frame;

comparing the primitive gray scale data of the (n−1)-th frame with the primitive gray scale data of the n-th frame to generate a second compensated gray scale data based on a lookup table.

15. The method of claim 10, wherein a driving frequency of the display apparatus is about 120 Hz.

* * * * *